United States Patent [19]

Coronado

[11] Patent Number: 4,516,800

[45] Date of Patent: May 14, 1985

[54] DEVICE FOR PICKING UP AND HANDLING DRAFTING TEMPLATES, TRIANGLES AND THE LIKE

[76] Inventor: Rodolfo A. Coronado, 35012 Hollyhock St., Union City, Calif. 94587

[21] Appl. No.: 474,568

[22] Filed: Mar. 11, 1983

[51] Int. Cl.[3] ..... A47B 97/06

[52] U.S. Cl. ..... 294/64.1; 294/25

[58] Field of Search ..... 294/64 R, 64 A, 64 B, 294/25; 248/206 R, 362; 401/88

[56] References Cited

U.S. PATENT DOCUMENTS 2,212,755 8/1940 Solomon ..... 294/64 R 3,542,411 11/1970 Filas ..... 294/64 R 4,091,945 5/1978 Patterson ..... 294/64 R

*Primary Examiner*—James B. Marbert

*Attorney, Agent, or Firm*—Flehr, Hohbach, Test, Albritton & Herbert

[57] ABSTRACT

A device especially suitable for handling flat-sided drafting tools such as triangles, templates, and the like, is disclosed herein. This device includes a handle adapted to be held by the fingers of a draftsman and a plurality of suction cups fixedly connected with the handle and positioned relative to the latter so as to easily attach to a flat side of any one of the drafting tools by means of suction while the handle is being held by the draftsman. In this way, the device can be used to pick up and manipulate the tools.

10 Claims, 11 Drawing Figures

DEVICE FOR PICKING UP AND HANDLING DRAFTING TEMPLATES, TRIANGLES AND THE LIKE

The present invention relates generally to drafting tools and more particularly to a device for picking up and handling templates, triangles and like drafting tools.

Drafting tools typically include triangles in varying sizes, and different types of templates having varying through hole configurations. All of these flat-sided tools have one thing in common. They are relatively thin and usually difficult for the draftsman to pick up from the drafting table. This is particularly troublesome when the triangle or template being used is to be picked up from the sheet being worked on. For example, if a draftsman is using a template and he does not pick it up in a straight-away manner, that is, in a direction perpendicular to the sheet, then any lead residue which might have accumulated on the template will most likely smudge the sheet.

In view of the above, it is an object of the present invention to provide a device which is especially suitable for handling flat-sided drafting tools such as the triangles and templates mentioned above in a way which allows these tools to be readily moved from a drafting sheet in a straight-away manner.

Another object of the present invention is to provide the last-mentioned device in an uncomplicated and economical embodiment.

Still another object of the present invention is to provide a device especially suitable for handling templates containing different shaped through holes spaced relatively close to one another and specifically a device which allows the template to be used with ink pens and soft leaded pencils without the problem of smearing the ink and smudging the lead.

As will be seen hereinafter, the drafting tool handling device disclosed herein comprises a handle adapted to be held by the fingers of a draftsman and a plurality of suction cups fixedly connected with the handle and positioned relative to the latter so as to easily attach to a flat side of any one of the tools by means of suction while the handle is being held by the draftsman, whereby the device can be used to pick up and manipulate a given tool. In a preferred embodiment, the plurality of suction cups includes two spaced-apart groups thereof. Each suction cup in each of these groups is at least as small as most, if not all, of the spaces between the through holes in the templates being used, whereby at least one suction cup in each group will attach to a given template.

This device and other embodiments thereof will be described in more detail hereinafter in conjunction with the drawings wherein.

Figure 1:
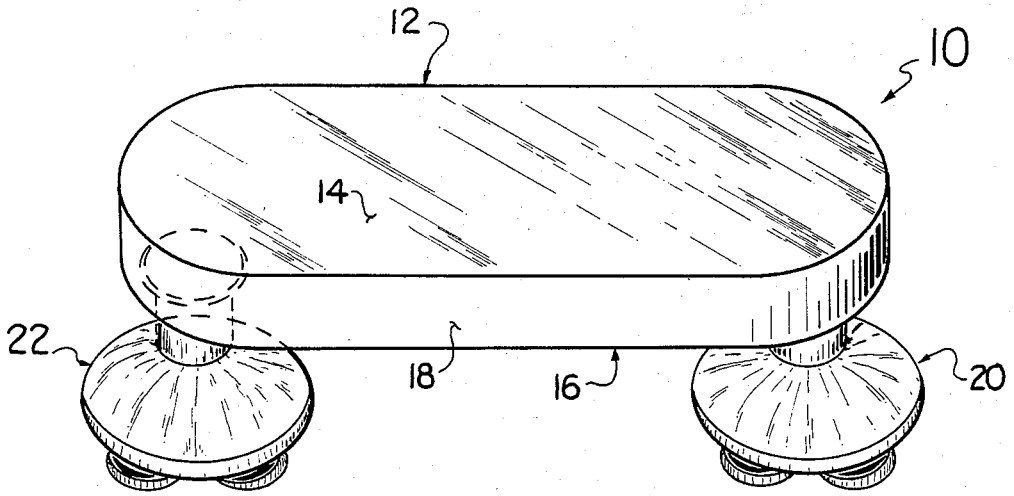
FIG. 1 is a perspective view of the device designed in accordance with a preferred embodiment of the present invention.

Turning now to the drawings, wherein like components are designated by like reference numerals throughout the various figures, attention is first directed to FIGS. 1–5 which illustrate a device designed in accordance with the present invention for handling flat-sided drafting tools such as triangles, templates, and the like. This device which is generally indicated by the reference numeral 10 includes an elongated handle 12 adapted to be held by the fingers of a draftsman. As best seen in FIG. 1, handle 12 includes a flat top side 14, an opposite flat underside 16 (see FIG. 2) and a continuous side wall 18 extending between the two. The handle may be constructed of any suitable material, preferably rigid, lightweight plastic.

Figure 2:
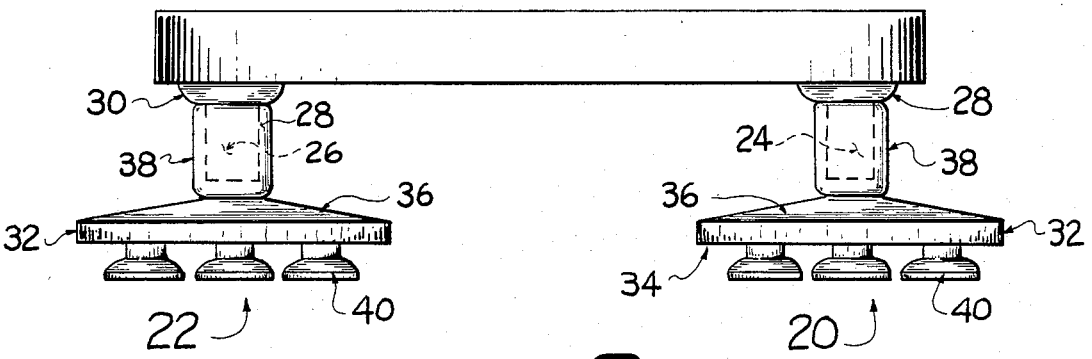
FIG. 2 is a side elevational view of the device illustrated in FIG. 1.
Figure 3:
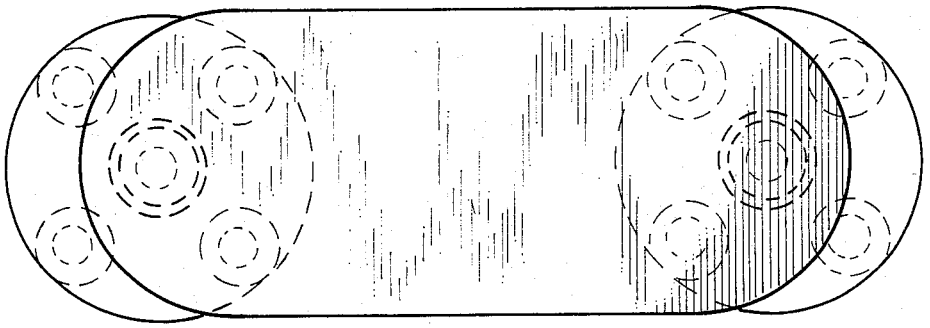
FIG. 3 is a top plan view of the device illustrated in FIG. 1, looking down on the latter.

Device 10 also includes a pair of suction cup arrangements 20 and 22 fixedly connected to the underside 16 of handle 12 by means of a pair of projecting members 24 and 26, respectively, as will be discussed below. As best illustrated in FIG. 2, these projections include enlarged rearwardmost ends 28 and 30 which are bonded or otherwise suitably fixedly connected to handle underside 16 at opposite ends of the latter such that the projections extend outwardly therefrom in a direction perpendicular thereto. While the projections can be separate and distinct components from handle 12 so as to require some form of bonding thereof, the handle and projections could be integrally molded into a single unit.

Referring now to the suction cup arrangements 20 and 22, attention is first directed to arrangement 20. As illustrated in FIGS. 1–5, this arrangement includes a generally cylindrically (relatively thin) main body 32 having a planar front face 34 (see FIG. 4) and an inwardly and rearwardly tapering back side 36 (see FIG. 2). A hollow stem 38 is fixedly connected at its front end to the back end of back side 36 and is open at its rearwardmost end (again see FIG. 2). Stem 38 is configured to receive a front end section of projection 24 such that the entire suction cup arrangement 20 is fixedly connected thereto. The main body 36 and stem 38 can be constructed of relatively rigid plastic or other suitable material or it can be constructed of more flexible material such as hard rubber. In either case, the opening into stem 38 can be designed to provide a force fit between the stem and projection 24 or it can be made to receive adhesive for bonding the stem to the projection. In this latter case, the connection between arrangement 20 and projection 24 becomes permanent. In the former case, the arrangement is disengagably connected with the projection so that it can be replaced with a new one, if necessary. In either case, front face 34 extends in a plane perpendicular to the axis of projection 24, that is, parallel to bottom side 16.

Figure 4:
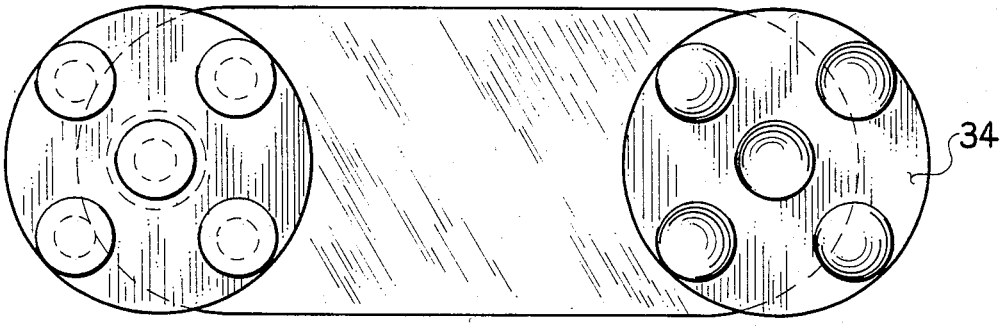
FIG. 4 is a bottom plan view of the device illustrated in FIG. 1, looking up from the underside of the latter.
Figure 5:
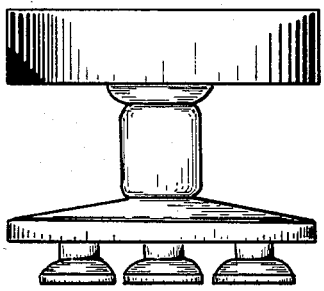
FIG. 5 is an end view of the device illustrated in FIG. 1.

In addition to the components thus far described, suction cup arrangement 20 includes a plurality of suction cups 40 which are fixedly connected to front face 34 of main body 32. The suction cups can be constructed of any suitable material, such as rubber or relatively resilient plastic which allows them to attach to relatively smooth, flat surfaces by means of suction. In the particular embodiment illustrated, five such suction cups are shown, four of which are equally spaced around the periphery of face 34 while one is located at the center of the latter, as best seen in FIG. 4. In this particular embodiment, front face 34 is circular in configuration.

Figure 10:
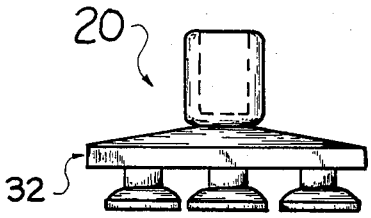
FIGS. 10 and 11 are respective side and underside views of suction cup arrangements designed in accordance with still another embodiment of the present invention and usable with either of the embodiments illustrated in FIGS. 1 and 9.
Figure 11:
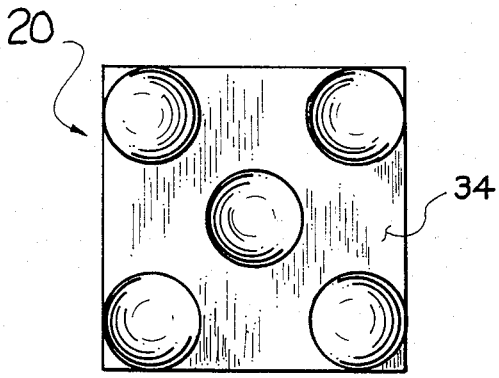

Overall suction cup arrangement 22 is preferably identical to arrangement 20 and therefore will not be described in detail herein. It suffices to say that arrangement 22 includes the same main body 32 having front face 34, tapering backside 36 and stem 38 as well as the same configuration of suction cups 40. Also, both arrangements could be modified as shown at 20′ in FIGS. 10 and 11.

Figure 6:
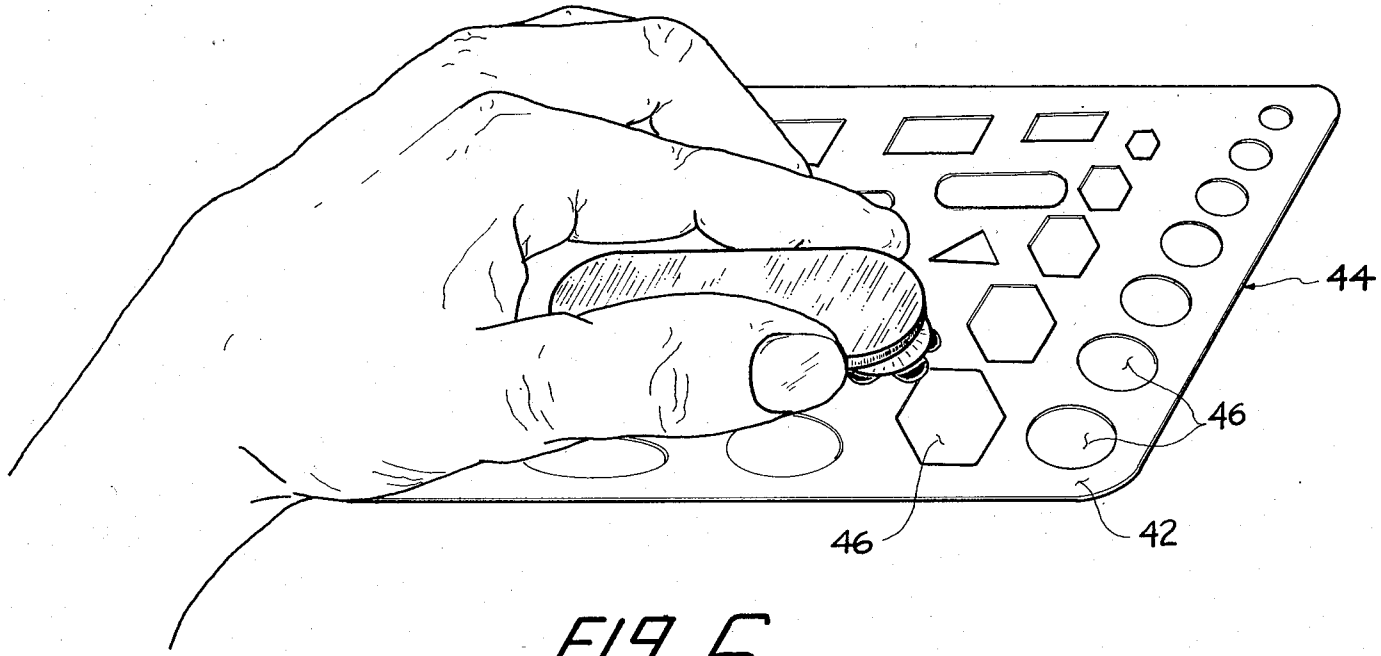
FIGS. 6 and 7 are perspective views illustrating how the device of FIGS. 1–5 can be used.

Having described overall device 10, attention is now directed to the way in which it can be used for handling flat-sided drafting tools such as triangles, templates and the like. To this end, reference is made to FIGS. 6 and 7. FIG. 6 illustrates a draftsman holding handle 12 of the device with his fingers, while the suction cups 40 engage against the top side 42 of a template generally indicated at 44. As seen in FIG. 6, this template includes a relatively large number of different shaped through holes 46 extending through the template body from top side 42 to its bottom side. These through holes are spaced relatively close to one another. As a result, in order for device 10 to be able to pick up the template, the suction cups 40 must be sufficiently small such that at least one and preferably one in each group will in its entirety engage the solid surface portion of top side 42 in order to attach thereto. If any given suction cup extends even slightly over one of the through holes, it will not attach by means of suction to the template. As a result, each suction cup must be at least as small in cross section (e.g., the area of its front face) as most, if not all, of the spaces between the through holes. In this way, when the draftsman manipulating device 10 goes to engage the template, the odds will be in his favor that at least one in each of the arrangements 20 and 22 will find a continuously solid section to adhere to. As a result, when the draftsman wishes to remove the template from the sheet being worked on, he merely has to attach device 10 to the top side 42 of the template, preferably without even having to look at the template other than out of the corner of his eye. He can then lift the template directly from the sheet in a perpendicular direction thereto in order not to smudge the sheet. Of course, once the device 10 is attached it will remain so attached for long periods of time. In addition, the draftsman can hold the template in spaced relationship to the sheet using the attached device in order to use the template with an ink pen without smearing the ink. Heretofore, it was difficult to use ink because of its tendency to be smeared by the template as the latter rested against the sheet.

Figure 7:
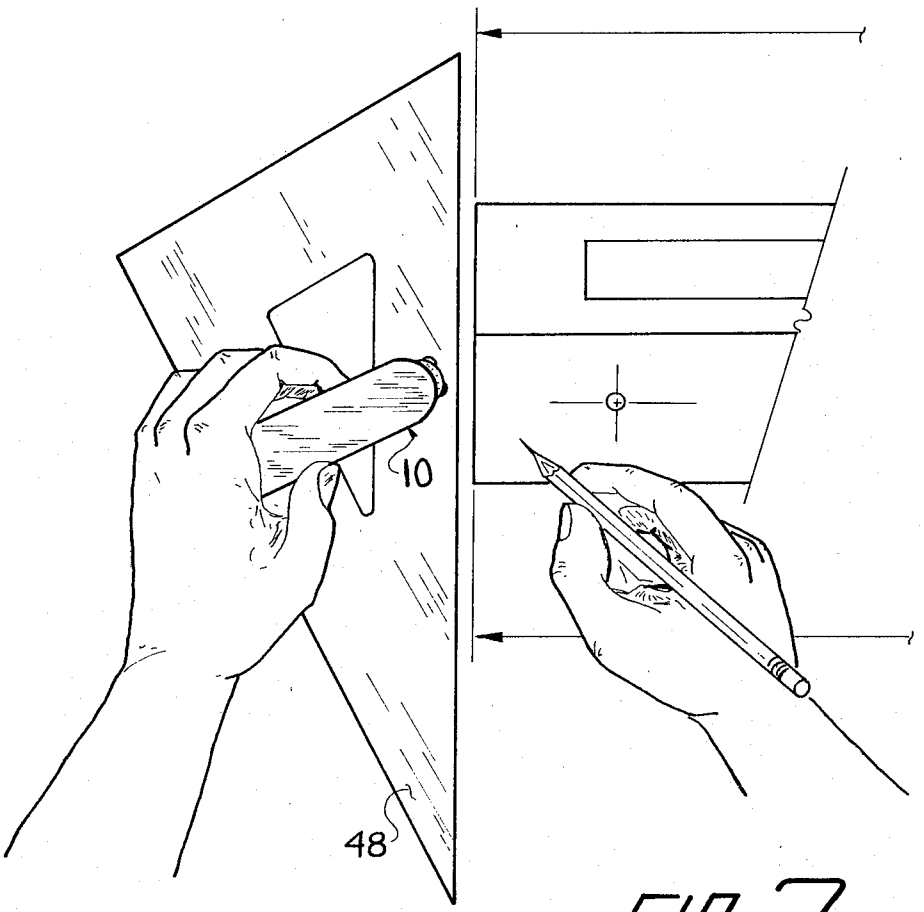

The size of the suction cups is not so critical when device 10 is being used to hold and manipulate a triangle which is illustrated at 48 in FIG. 7. This is because there is typically only a single opening through the triangle and a substantially larger amount of continuous surface than in a template. On the other hand, by providing a relatively large number of smaller suction cups, the device more reliably holds the triangle than would a lesser amount of larger suction cups. This can be advantageous since device 10 is likely to be used to manipulate the triangle (as well as for picking it up) during use of the latter. While templates are generally held down or picked up by the device 10, the device can also be used to manipulate it. In FIG. 7, device 10 is being shown holding the triangle at an incline to the drafting surface while the triangle is being used in this position.

Figure 8:
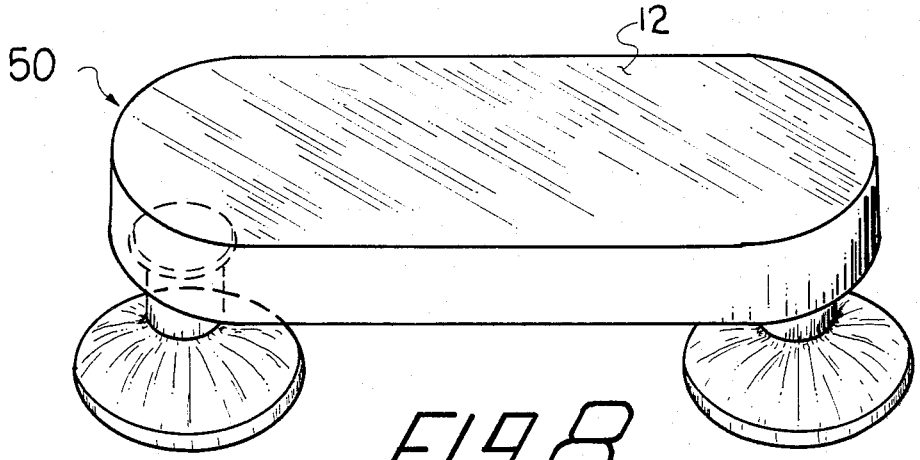
FIG. 8 is a perspective view of a device similar in function to the one illustrated in FIG. 1 but designed in accordance with a second embodiment of the present invention.
Figure 9:
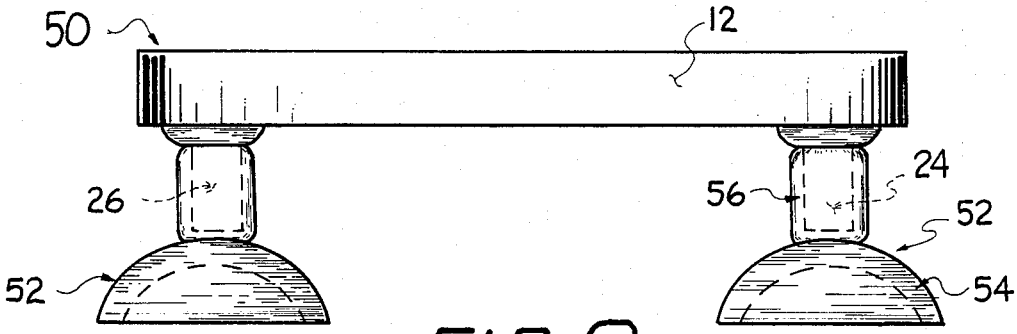
FIG. 9 is a side elevational view of the device illustrated in FIG. 8.

Having described overall device 10 and the way it can be used, as well as modified suction cup arrangement 20′, attention is now directed to FIGS. 8 and 9 which illustrate a device 50 identical to device 10, except for its suction cup arrangement. Accordingly, device 50 includes the same handle 12 or any other suitably shaped handle and the same projections 24 and 26 extending out from the bottom side 16 of the handle. The modified suction cup arrangements are generally indicated at 52. Each is comprised of a single suction cup 54 which is fixedly connected to the forwardmost end of a rearwardly extending hollow stem 56 which corresponds in structure and function to stems 38. As a result, the stems 56 are configured to receive projections 24 and 26 in a fixedly connected or disengagably connected fashion such that the suction cups 54 face away from bottom side 16 of handle 12. These single suction cups serve the same purpose as the two groups of suction cups 40 but may be more practical for use with a triangle or similar tool having large continuous surfaces rather than templates of the type illustrated in FIG. 6.

What is claimed is:

1. A device for handling flat-sided drafting templates having various shaped through holes extending between opposite flat sides of the latter in spaced apart relationship to one another, said device comprising a handle adapted to be held by the fingers of a draftsman and a plurality of suction cups fixedly connected with said handle and positioned relative to the latter so as to easily attach to a flat side of any of said templates by means of suction while said handle is being held by said draftsman, whereby the device can be used to pick up and manipulate said tools, said plurality of suction cups including a group thereof, positioned adjacent to one another, each of which is at least as small in cross section as most, if not all, of spaces between said through holes in said templates, whereby at least one of said suction cups can be attached in its entirety to a given one of said templates.

2. A device according to claim 1 wherein said group of suction cups includes more than two such cups.

3. A device according to claim 2 wherein said plurality of suction cups includes said first group and a second group of identical suction cups spaced from said first group.

4. A device according to claim 3 wherein said handle is elongated in configuration so as to define a top side and a bottom side and wherein said handle includes means fixedly connecting said first and second groups of suction cups to said bottom side.

5. A device according to claim 4 wherein each group of said suction cups define an outermost circular periphery within which the suction cups are disposed.

6. A device according to claim 4 wherein each group of said suction cups defines an outermost rectangular array within which the suction cups are disposed.

7. A method of handling flat-sided drafting templates having various shaped through holes extending between opposite flat sides thereof in spaced relationship to one another, said method comprising the steps of: providing a template handling device having a handle and a plurality of suction cups fixedly connected with said handle, said plurality of suction cups including a group thereof positioned adjacent to one another, each of which is at least as small in cross section as most, if not all, of the spaces between said through holes and said last-mentioned template; and holding the handle of said device while manipulating the suction cups in a way which causes at least one of said cups to engage in its entirety a continuous flat side surface portion of said template between adjacent ones of said openings so as to cause said one suction cup to attach to said side section whereby the device can be used to pick up and manipulate that tool.

8. A device for handling templates having opposite flat sides and various shaped through holes extending between said flat sides in spaced apart relationship to one another, said device comprising an elongated handle having a top side and a bottom side; first and second projections fixedly connected to said bottom side at opposite ends thereof, and extending out from said bottom side in perpendicular directions with respect to the latter; and first and second suction cup arrangements having main bodies disengagably connected to said first and second projections, respectively, each of said main bodies fixedly supporting a plurality of adjacently positioned suction cups facing away from said handle in a plane normal to the axes of said projections, each of said suction cups being at least as small in cross section as most if not all, of the spaces between the through holes in said templates.

9. A device according to claim 8 wherein the main body of each of said suction cup arrangements is generally circular in configuration.

10. A device according to claim 8 wherein the main body of each of said suction cup arrangements is rectangular in configuration.

* * * * *